United States Patent [19]

Schmidt

[11] Patent Number: 4,525,079

[45] Date of Patent: Jun. 25, 1985

[54] SYSTEM FOR RETAINING A WALL ON A CLOCK HOUSING

[75] Inventor: Karl W. Schmidt, Idar-Oberstein, Fed. Rep. of Germany

[73] Assignee: Gebrüder Schmidt GmbH & Co. KG, Idar-Oberstein, Fed. Rep. of Germany

[21] Appl. No.: 506,680

[22] Filed: Jun. 22, 1983

[30] Foreign Application Priority Data

Dec. 13, 1982 [DE] Fed. Rep. of Germany ..... 3246100

[51] Int. Cl.[3] ..... G04B 37/00

[52] U.S. Cl. ..... 368/276

[58] Field of Search ..... 368/88, 276, 294–296, 368/301–303, 309, 311; 220/306, 309, 324, 326

[56] References Cited

U.S. PATENT DOCUMENTS

| | | | |
|---|---|---|---|
| 3,281,936 | 11/1966 | Haan et al. | 220/326 |
| 3,608,304 | 9/1971 | Schaad | 368/309 |
| 4,032,035 | 6/1977 | Tepas | 220/326 |

FOREIGN PATENT DOCUMENTS

| | | | |
|---|---|---|---|
| 1150306 | 1/1958 | France | 368/309 |
| 56-8584 | 1/1981 | Japan | 368/309 |
| 448985 | 6/1936 | United Kingdom | 368/300 |
| 544380 | 4/1942 | United Kingdom | 368/309 |
| 1200717 | 7/1970 | United Kingdom | 368/309 |
| 1246195 | 9/1971 | United Kingdom | 368/309 |
| 1300038 | 12/1972 | United Kingdom | 368/309 |
| 2066525 | 7/1981 | United Kingdom | 368/309 |
| 2101191A | 1/1983 | United Kingdom | 368/309 |

*Primary Examiner*—Vit W. Miska

*Attorney, Agent, or Firm*—Karl F. Ross; Herbert Dubno

[57] ABSTRACT

A clock housing has a rectangular housing body formed with an opening adapted to receive the rear wall or a wall engaging a viewing window through which the clock face is visible. To compensate for dimensional variations resulting from the injection molding or die-casting of the body, spring clips are provided to hold the wall in place. These spring clips reach over the opening in the body and are provided with bights which engage in undercuts of the wall.

9 Claims, 8 Drawing Figures

PRIOR ART

SYSTEM FOR RETAINING A WALL ON A CLOCK HOUSING

CROSS REFERENCE TO RELATED APPLICATION

This application is related to the concurrently filed corresponding application Ser. No. 506,712.

FIELD OF THE INVENTION

My present invention relates to a system for retaining a wall on a clock housing and, more particularly, to a clock housing having a movable wall, e.g. the face wall or the back wall of a clock housing, to an assembly formed by the clock housing, the removable wall and the retaining means, and retaining devices for this specific use.

BACKGROUND OF THE INVENTION

Modern clock housings are generally diecast from metal or injection molded from synthetic resin materials (plastics) and at least one movable wall affording access to the interior of the housing to allow the clockwork to be inserted and to afford access to the clockwork for repair or maintenance or to afford access to the hands of the clock for setting, adjustment or replacement.

The movable wall is generally either the back wall or the front wall or the bezel of the housing and, in the latter case, carries the window or glass through which the clock face is viewed. In some cases, both the front wall and the rear wall may have to be removable or detachable.

Generally speaking, the diecasting of metal housing and the injection molding of plastic housings are prone to fluctuations which cause considerable variation in wall thicknesses and in other dimensions of the fabricated housing. Conventional methods of assembling such housings with their movable walls have used snap-fitting formations formed directly on the wall and molded into the wall of the housing, or screw connections.

The interfitting formations are not practical where dimensional tolerances cannot be effectively controlled as is the case with both injection molding and diecasting, where the precision and reproducibility of the housing which is produced is a function of the conditions under which the shaping or matching operations take place. For example, both methods of manufacture are sensitive to the temperature of the die or mold and to variations of this temperature from point to point, fluctuations in the compositions and homogeneity of the materials which are used to fabricate the housing, factors such as the flow of the material and the like. As a consequence, the snap-fitting housings and movable walls in which the wall and the housing are both shaped with the interfitting formations directly, have not proved to be satisfactory.

The use of screw fastenings is not as sensitive to these variations and dimensions but involves other difficulties or problems. For example, in metal diecastings, it is necessary to cut screw threads or the like to accommodate the screws in costly operations.

With injection molded plastic housings, it is necessary to injection mold threaded metal bushings into the plastic material.

Even the use of self-tapping screws is associated with problems since such screws are generally relatively small and frequently are overdriven and stripped so that the housing becomes completely unusable.

OBJECTS OF THE INVENTION

It is the principal object of the present invention to provide an improved assembly for securing a wall, especially the rear wall or the front wall, or window-carrying bezel of a clock housing or casing to the body of this housing or casing in a way which can obviate the drawbacks of earlier systems described.

Still another object of this invention is to provide a low cost, easily fabricated and reliable retaining system for releasably securing a wall to a clock housing in a manner which is not sensitive to dimensional tolerances of the parts which are joined and easily is accommodated to relatively wide fluctuations in dimension resulting from diecasting or injection molding of the parts.

SUMMARY OF THE INVENTION

These objects and others which will become apparent hereinafter are attained, in accordance with the present invention, in a clock housing or casing which comprises a housing body having an open side, a wall adapted to close this side and at least one spring wire clip affixed to the housing body and engaging this wall for releasably retaining it in place, the clip having a bight which engages into an undercut or other indentation in this wall to retain the wall in place.

According to a feature of the invention, the clip comprises a U-shaped bent-wire member having a pair of shanks interconnected by the aforementioned bight which can include a bar substantially at right angles to the shanks, the shanks having angularly bent ends and being retained in respective holes of a pair of outwardly extending flanges on opposite flanks of the housing body with the bights reaching over the edge of an opening on the aforementioned side of the housing body to be closed by the wall.

According to a feature of the invention, the wall has along opposite edges thereof upstanding ridges adapted to penetrate into this opening and formed with outwardly open grooves underhanging ledges on these ridges or ribs into which the bights can spring when the housing wall is thrust against the housing body and these ribs are introduced into the opening past the bights.

The shanks can have, in addition to the portions at right singles to the bight-forming bar, legs which diverge outwardly toward the angularly bent or offset portions.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
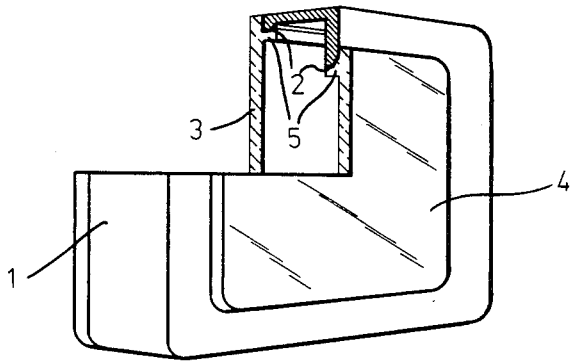
FIG.1 PRIOR ART
FIG. 1 is a perspective view of a prior art clock housing illustrating the problem attacked by the invention.

FIG. 1 shows a conventional housing body 1 in the form of a frame 1 having bevels 2 along its inner edges. The rear wall cover 3 and the glass or window 4 are each provided with undercut formations 5 in which the bevels 2 are received. This system is obviously sensitive to dimensional variations since any increase in size at the bevels 2 will prevent interfitting of the parts while any decrease in size beneath the requisite thickness will permit the rear wall or glass to move in the frame.

Figure 2:
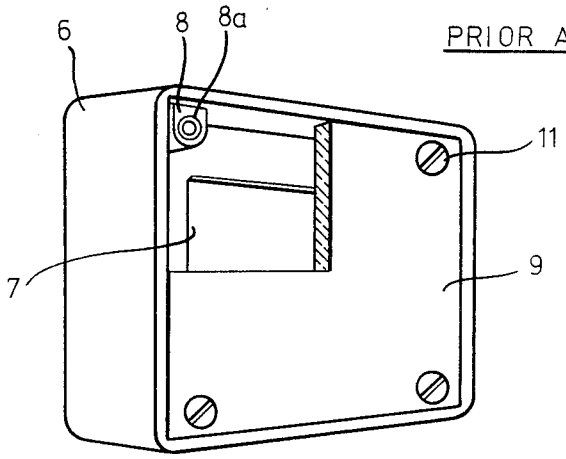
FIG. 2 is a perspective view of another prior art housing, also partly broken away.

In the housing of FIG. 2, the housing body 6 is molded with a cutout or opening 7 for a window and has corner posts 8 in which metal sleeves 8*a* must be molded to accommodate the screws 11 securing the rear wall 9 in place. Molding such bushings into the synthetic resin housing body is a costly and frequently unsatisfactory operation, whereas the use of self-tapping screws has the disadvantage described previously.

Figure 3B:
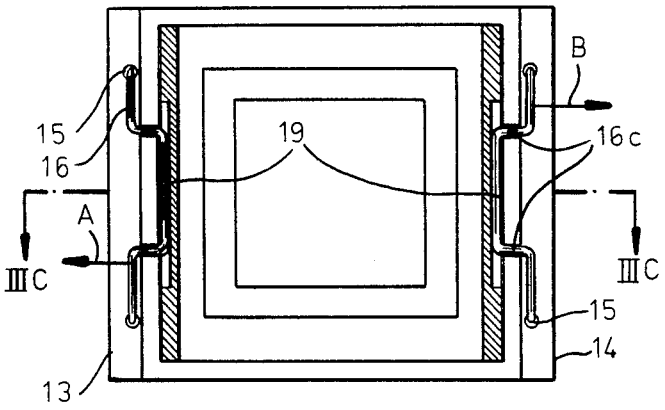
FIG. 3B is a cross-sectional view taken along the line IIIB—IIIB of FIG. 3A.
Figure 3A:
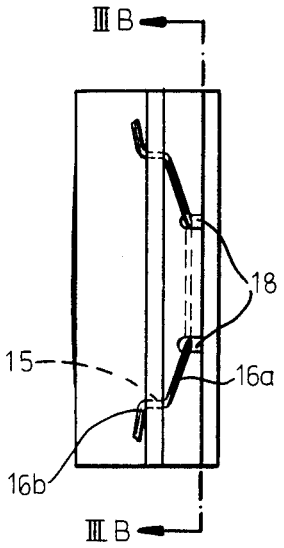
FIG. 3A is a side-elevational view of a housing or casing according to the invention.
Figure 3C:
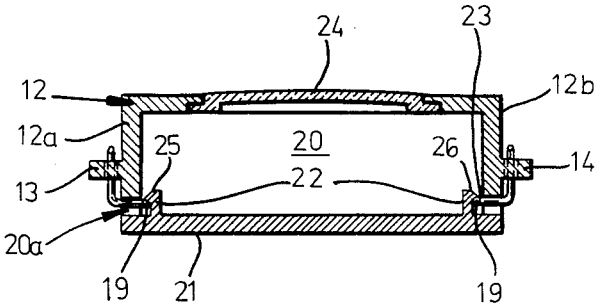
FIG. 3C is a cross-sectional view taken along the line IIIC—IIIC of FIG. 3B.

In FIGS. 3A–3C I have shown a housing or casing according to the invention, which comprises a box-shaped housing body 12 on two outer flanks of which, laterally extending flanges 13 and 14 are provided. The flanges 13 and 14 are provided with bores 15.

Retaining clips 16 have their shanks 16*a* extending into the bore 15 and anchored therein by angularly bent portions 16*b*, the mutually divergent shank 16*a* terminating in shank portions 16*c* which lie at right angles to a bight formed by a bar 19 which extends parallel to the flanges 13 and 14.

To guide the shanks, the side walls 12*a* and 12*b* of the housing are provided with notches 18. The bights 19 (see FIG. 3C) project over the opening 20*a* to the interior 20 of the housing so as to engage a pair of ribs 22 of the back plate or wall 21. The ribs 22 are formed with undercuts 23 below outwardly projecting ledges 25 which have bevels 26. Thus, when the rear plate 21 is thrust into place, the bevels 26 cam the bights 19 outwardly until these bights spring past the ledges 25 and engage in the undercuts 23 to hold the cover in place. By drawing the spring clips 16 slightly outwardly in the direction of arrow A or B (FIG. 3B), the undercuts can be released and the cover removed. It should be apparent that these spring clips are not sensitive to dimensional variations of either the box-like housing or the rear wall. The interior 20 of the housing, of course, represents the lens or window through which the hands of the clock can be viewed.

Figure 4B:
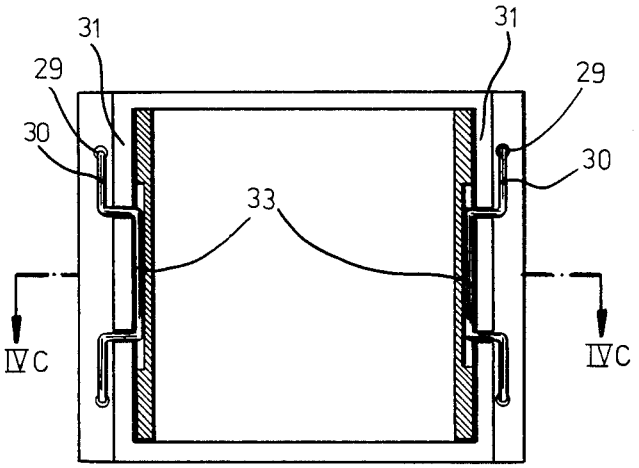
FIG. 4B is a cross-sectional view along the line IV-B—IVB of FIG. 4A.
Figure 4A:
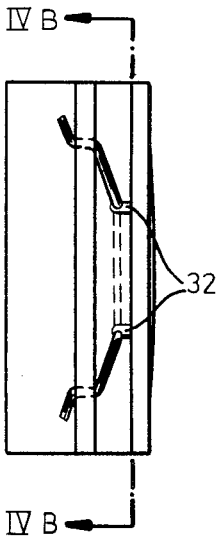
FIG. 4A is a view similar to FIG. 3A but illustrating an embodiment of the invention wherein the bezel or lens-carrying face of the clock is removably mounted on the housing body.
Figure 4C:
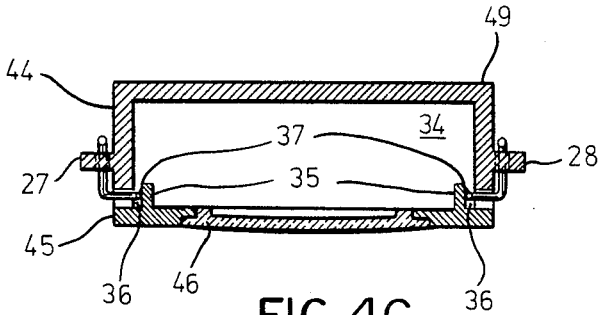
FIG. 4C is a cross-sectional view along the line IV-C—IVC of FIG. 4B.

In FIGS. 4A through 4C, I have provided similar views for a system in which the housing 44, molded with a rear wall 49, receives a bezel 45 with a viewing glass 46 through which the face of the clockwork is exposed. In this embodiment, flanges 27 and 28 are provided on the lateral flanks of the housing and have bores 29 which receive the angularly bent ends of the shanks or legs of the spring clips 30. The side walls 31 of the housing have outwardly open slits or notches 32 in which the shanks of the spring clips, bent outwardly to overlie the opening in the manner described, in connection with the embodiment of FIGS. 3A through 3C, are received.

The detent edges 33 of the spring clips 30 thus lie slightly inwardly of the side walls within the interior 34 of the housing and engage the ribs 35 of the bezel when the bevels 37 thereon are forced past the spring clips to enable the latter to engage in the undercuts 36.

I claim:

1. A clock housing comprising: a diecast or injection molded housing body of generally rectangular configuration formed with a generally rectangular opening at one side, a wall adapted to close said opening and formed with a pair of undercuts on opposite sides thereof, and a pair of spring clips are provided at opposite flanks of said housing body to reach over said opening from opposite sides thereof and engaging in respective ones of said undercuts, each of said clips being of generally U-shaped configuration having a bight reaching over said opening and a pair of shanks extending from said bight and secured to the respective flanks of said body, said body having sides along said flanks formed with notches receiving said shanks.

2. The clock housing defined in claim 1 wherein each of said flanks is formed with an outwardly extending flange provided with a pair of bores, said shanks having angularly bent portions received in the respective bores.

3. The clock housing defined in claim 2 wherein said wall is provided with a pair of ribs, each of said ribs being formed with a respective undercut adapted to receive the bight of a respective clip.

4. The clock housing defined in claim 3 wherein each of said ribs is outwardly bevelled to deflect the respective bight outwardly as said ribs are thrust into said opening.

5. The clock housing defined in claim 4 wherein each of said bevels is formed on a ledge of the respective rib overhanging the respective undercut.

6. The clock housing defined in claim 5 wherein said wall is a rear wall of said body, said body being provided with a transparent face through which a face can be viewed.

7. The clock housing defined in claim 5 wherein said wall is a bezel formed with a transparent window through which a clock face may be viewed.

8. The clock housing defined in claim 5 wherein said bights are straight bars parallel to said flanges and said ribs.

9. A clock housing comprising:

housing body formed with an opening and a pair of parallel walls along opposite sides of said body flanking said opening, each of said sides being formed with a respective outwardly extending flange having a pair of spaced-apart bores formed therein;

a cover receivable in said opening and having a pair of undercuts along opposite sides of said cover juxtaposed with said walls; and a pair of spring clips for retaining said cover on said body, said spring clips being composed of bend wire and each having a respective bight with a rectangular portion receivable in a respective one of said undercuts, a pair of arms extending away from the respective bight, and respective legs engageable in the bores of the respective flange.

* * * * *